United States Patent [19]

Rowe, Jr.

[11] Patent Number: 4,580,363

[45] Date of Patent: Apr. 8, 1986

[54] HOLDER FOR A MAGAZINE FOR A FIREARM

[76] Inventor: Charles E. Rowe, Jr., 42 Bittersweet La., Weston, Mass. 02193

[21] Appl. No.: 660,034

[22] Filed: Oct. 12, 1984

[51] Int. Cl.[4] ..... F41C 25/02

[52] U.S. Cl. ..... 42/18; 42/6

[58] Field of Search ..... 42/6, 7, 18, 22, 49 A, 42/50; 124/45

[56] References Cited

U.S. PATENT DOCUMENTS 2,125,350 8/1938 Loomis ..... 42/18

*Primary Examiner*—Charles T. Jordan

*Attorney, Agent, or Firm*—Charles R. Fay

[57] ABSTRACT

A multiple catch for different magazines for firearms, so that magazines of various manufacturers can be used in a single gun.

6 Claims, 4 Drawing Figures

HOLDER FOR A MAGAZINE FOR A FIREARM

BACKGROUND OF THE INVENTION

In the case of automatic and semi-automatic weapons, a detachable magazine is ordinarily used, and this magazine is of course changed when it runs out of ammunition to a fresh full magazine. Ordinarily, there is a notch on the magazine and a spring biased catch of some kind on the magazine holder or guide box so that when the magazine is slapped into the holder, it automatically latches; when empty, the catch is manually retracted against its spring.

Different manufacturers place the magazine holding notch at distances from the firing chamber so that the spring biased magazine catch will not snap into the magazine holding notch unless the catch and notch coincide with the magazine in firing position. Therefore, each manufacturer requires that a user for the firearm will have to use the magazine of the manufacturer, even though two different magazines are otherwise alike and can be interchangeably used except for this feature.

It is the object of the present invention to provide a magazine latching and release member which is multiple in a direction parallel to the direction of the magazine insertion and retraction from the magazine holder so that different magazines, regardless of manufacture, may be used in a single weapon having the holder of this invention. This is particularly useful in police weapons such as sub-machine guns and machine pistols.

SUMMARY OF THE INVENTION

In the present case, it may be assumed that the magazine has a simple notch in it to automatically receive a magazine holding catch on the magazine holder. The catch is spring biased and automatically snaps into the magazine notch to hold the magazine in firing position. In this case, the catch is manually operated for retracting it to allow the magazine to be extracted and it is multiple; i.e., it has a least two and possibly a series of spring biased plungers which are all mounted on a single operative member so that when this member is retracted, whatever plunger happens to have locked the magazine in place, is retracted therefrom along with the others. In other words, a single magazine holder may be made to accept two or more different manufacturers' automatic or semi-automatic firearm magazines without having to associate one manufacture's magazine with the same manufacturer's firearm. In the case of police work especially this is a very advantageous factor. It is sometimes desirable to have weapons made by different manufacturers, and therefore this invention is to provide for the use of different manufacturers' magazines in different manufacturers' weapons without stopping to see whether or not the magazine have the holding notches in correct alignment with the spring biased catch of the firearm in use.

This invention will be seen to be directed to the magazine and the magazine holder of a firearm more or less regardless of the other characteristics of the firearm and whether it be automatic or semi-automatic or even a manual operation repeater.

PREFERRED EMBODIMENT OF THE INVENTION

Figure 1:
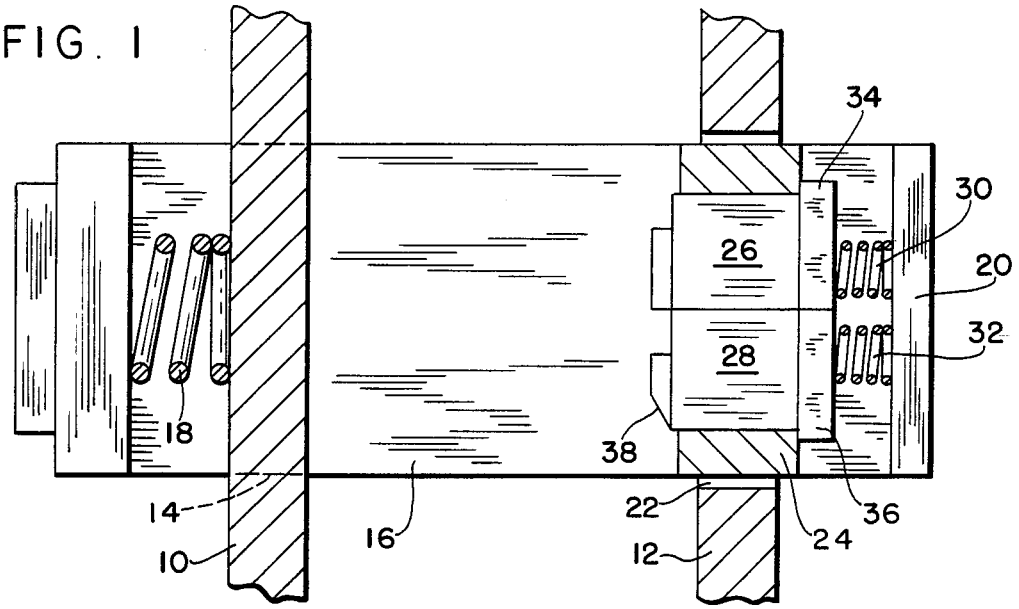
FIG. 1 is a view of the magazine holder in section with no magazine.

Only so much of the construction is shown as will clearly describe the invention, and it is pointed out that cartridge magazines are per se old and well known, and that they have a wedge shaped nose with an opening for insertion and passage of the cartridges. This shaped end of the magazine retracts the usual magazine holding catch as is well known to cause it to lock the magazine in firing position. This is also the case herein.

The holder or guide box has walls 10 and 12, among others, and these walls are of course fixed relative to the receiver of the weapon as usual. The wall 10 may be apertured at 14 for the sliding reception of the catch actuator 16 which has a bias to the left under the action of spring 18. The actuator also has an end abutment 20 to the right of wall 12, the actuator passing through a part of the holder as at 22, but with clearance to allow the entry and abstraction of the magazines through the bottom of the holder, in the usual manner.

Figure 2:
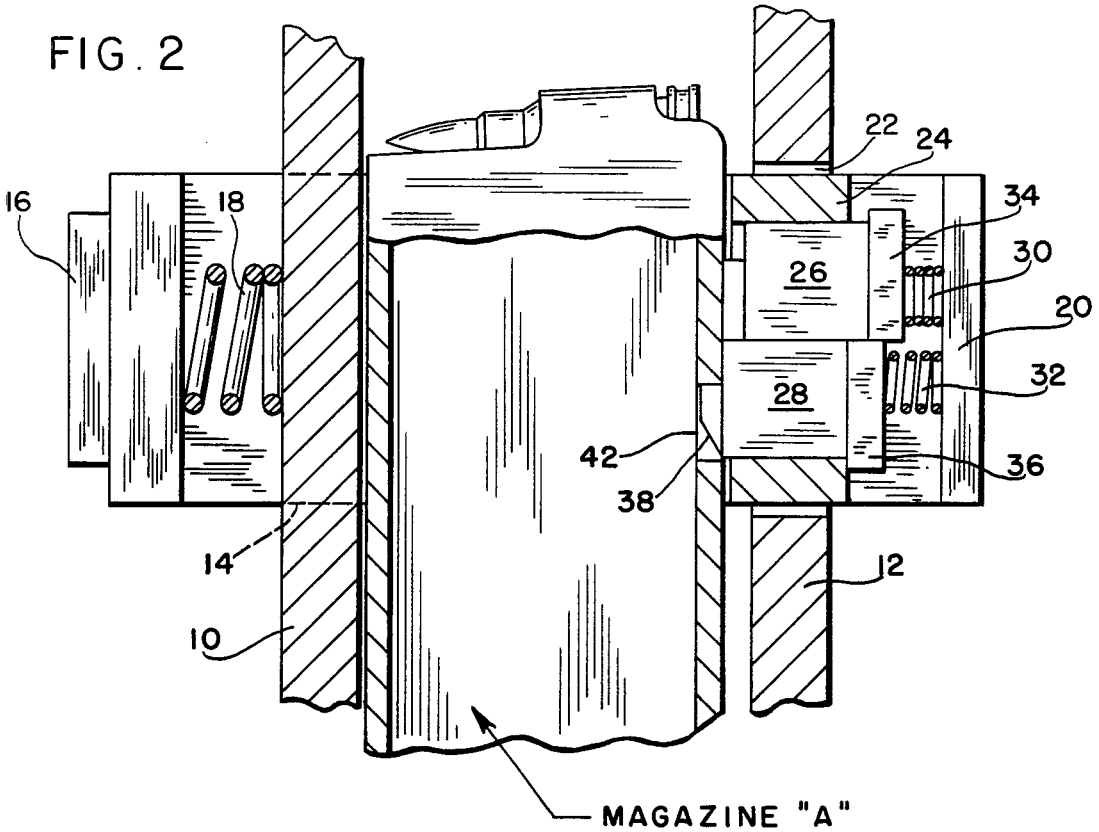
FIG. 2 is a like view with one magazine.

A fixed portion of the holder or other support at 24 slidably supports the catches, at least two in number, and these are indicated at 26 and 28. Each has a separate biasing spring 30 and 32 acting between the abutment 20 and the enlarged stops 34 and 36 at the respective bases of the catches so that the catches are seen to be equally resiliently urged to the left but stopped as in FIG. 1 by impingement of stops 34 and 36 against support 24. Thus the catches, regardless of number, are movable together by the actuator or separately by the magazine, see FIGS. 2 and 3. Catch 28, the lower catch herein, has a cam surface or chamfer 38 at its lower edge.

When the magazine is slid up into the magazine holder or guide box, the various catches or plungers are retracted automatically by the magazine itself to allow the magazine to pass and to become fully seated with the appropriate catch projected into its corresponding notch to latch the magazine in operative relation to the firing chamber of the respective weapon. To free the magazine and extract it, it is only necessary to press the magazine catch actuator, retracting both or all the catches simultaneously. The magazine can then be pulled out while the catches are thus retracted. Once the magazine is past the plungers on its outward travel, the actuator can be manually released and the free ends of the catches will simply ride on the magazine with no interference.

Figure 3:
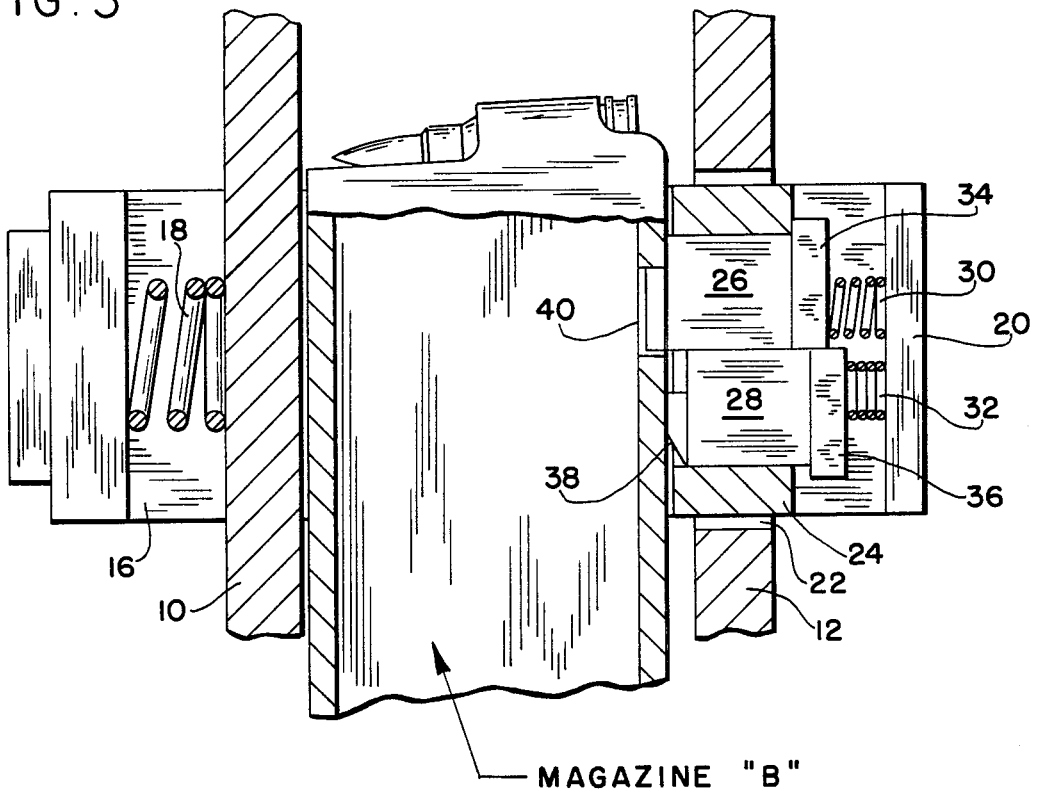
FIG. 3 is the same as FIG. 2 with a different magazine.
Figure 4:
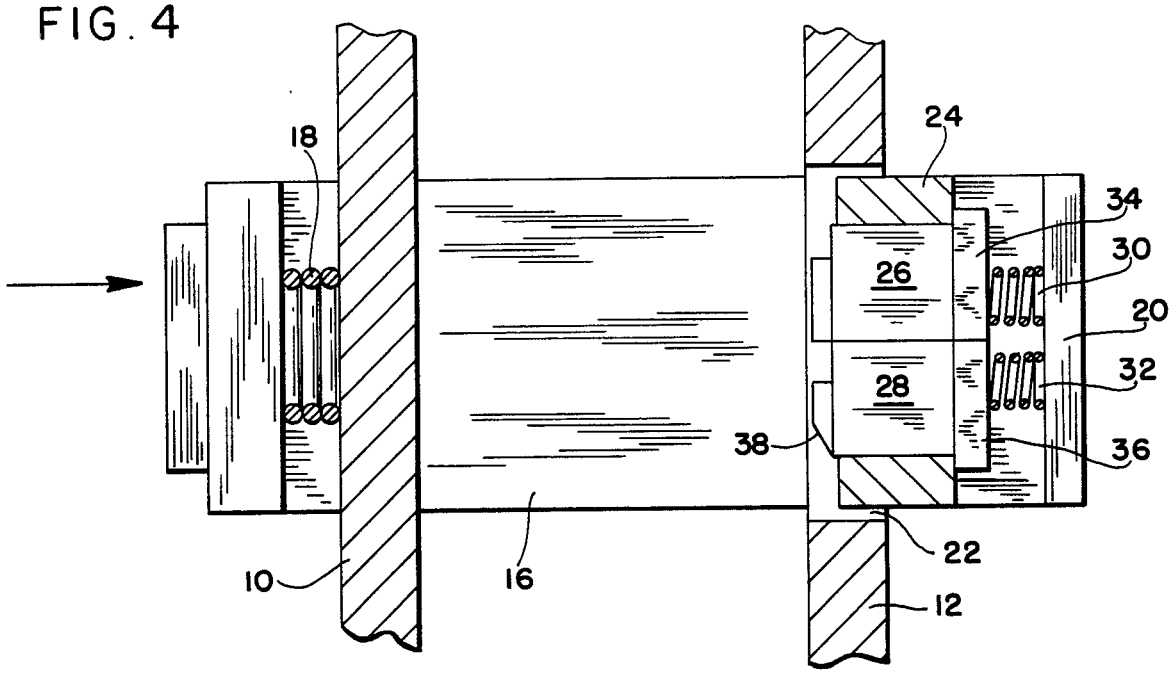
FIG. 4 is a like view with all catches in release position.

The cam or chamfer 38 on the lower catch is only necessary to allow the slot 40 of magazine B to pass it without catching, see FIG. 3. There is no problem with magazine A as its slot 42 will not reach catch 26.

Catches 26 are interchangeable with like catches with different sizes of or positioned extensions to accommodate further different firearm magazines.

I claim:

1. In a firearm, a magazine holder, a detachable magazine having a holding notch, a spring biased magazine catch actuation member on the holder for engagement of the magazine holding notch on the detachable magazine, said catch actuation member being manually retractable to release the notch and comprising at least two relatively independent catches, a separate spring biassing means for each of said catches, the catch actuating member movably mounting both catches separately with their spring biassing means, spring biassing means for the catch actuating member for simultaneous retraction of both catches, said catches being mounted to move in a direction at an angle to the motion of the magazine to seat it in the holder, at least one catch coiniciding with the notch in seated condition of the magazine whereby one catch will engage the magazine holding notch.

2. The firearm of claim 1 wherein the force of the spring biassing means for the catch actuating member is great enough to overcome the total force of all the separate spring biassing means for the catches.

3. The firearm of claim 1 including a cam surface on at least one catch for retracting it upon motion of the magazine in one direction in the holder.

4. The firearm of claim 1 wherein the spring biassing means for the catches comprises a separate spring for each catch.

5. The firearm of claim 1 including manually operable means to retract said catch actuating member.

6. The firearm of claim 1 wherein the catches are interchangeable with like catches of varied projection and size.

* * * * *